US007836844B2

(12) United States Patent
Golovin et al.

(10) Patent No.: US 7,836,844 B2
(45) Date of Patent: Nov. 23, 2010

(54) METHOD FOR PROTECTING AGAINST CORROSION AND SCALE DEPOSIT AND FOR RESTORING TUBES OF HEAT-EXCHANGING EQUIPMENT AND DEVICE FOR CARRYING OUT SAID METHOD

(75) Inventors: Vladinir Anatolievich Golovin, Moscow (RU); Vitaly Timofeevich Kuznets, Moscow (RU); Kirill Valentinovich Kublitskiy, Moscow (RU); Alexander Borisovich Ilin, Moscow (RU)

(73) Assignee: Obschestvo S Ogranichennoi "Nauchno-Proizvodstvennoe Obiedinenie Rokor"

( * ) Notice: Subject to any disclaimer, the term of this patent is extended or adjusted under 35 U.S.C. 154(b) by 1077 days.

(21) Appl. No.: 10/485,580

(22) PCT Filed: Aug. 6, 2002

(86) PCT No.: PCT/RU02/00373

§ 371 (c)(1),
(2), (4) Date: Feb. 2, 2004

(87) PCT Pub. No.: WO03/014418

PCT Pub. Date: Feb. 20, 2003

(65) Prior Publication Data

US 2004/0175495 A1 Sep. 9, 2004

(30) Foreign Application Priority Data

Aug. 7, 2001 (RU) ..... 2001121975

(51) Int. Cl.
*B05C 7/06* (2006.01)
*B05C 7/00* (2006.01)
*B05C 7/08* (2006.01)
*B05D 7/22* (2006.01)

(52) U.S. Cl. ..... 118/408; 118/DIG. 10; 427/142; 427/231; 138/97

(58) Field of Classification Search ..... 427/140, 427/142, 230, 231, 239; 118/400, 407, 408, 118/DIG. 10, DIG. 13; 138/97, DIG. 7
See application file for complete search history.

(56) References Cited

U.S. PATENT DOCUMENTS

| | | | | | |
|---|---|---|---|---|---|
| 3,112,227 | A | * | 11/1963 | Curtis | 118/408 |
| 3,885,521 | A | * | 5/1975 | von Arx | 118/105 |
| 4,069,535 | A | * | 1/1978 | Cato | 15/104.061 |
| 4,425,385 | A | * | 1/1984 | Coulter et al. | 427/238 |
| 4,774,905 | A | * | 10/1988 | Nobis | 118/304 |

FOREIGN PATENT DOCUMENTS

CA 1061198 A * 8/1979

OTHER PUBLICATIONS

Derwent Abstract 1979-25501B for SU 606641 A, published Apr. 26, 1978.*

* cited by examiner

*Primary Examiner*—William Phillip Fletcher, III
(74) *Attorney, Agent, or Firm*—James P. Hanrath

(57) ABSTRACT

The inventive method for protecting from corrosion and scale deposit and restoring tubes of heat-exchanging equipment consists in applying a polymeric coating on the internal surface of tubes by gradually and rotationally moving an excessive volume of polymeric material therealong and in hardening said material. A polymeric compound having an at-rest viscosity ranging from 1000 to 1200 poises and a thixotropic viscosity reduction during the displacement thereof is used as a polymeric material. The inventive device for carrying out said method comprises a loading chamber (2), a connecting washer (12), a unit for progressively displacing the polymeric material provided with spaced rigid washers (4,5,6) fixed to a metallic rod (7), an elastic screw (8) having a conical shape whereby the conicity thereof ranges from 5 to 10° on the side which is opposite in relation to the connecting washer. Said elastic screw is arranged in such a way that it is enable to perform the gradual rotation, the rotation displacement being performed at a linear speed of 0.4-1.0 m/sec and the gradual displacement being performed at a speed of 1-0.49 m/sec.

10 Claims, 1 Drawing Sheet

METHOD FOR PROTECTING AGAINST CORROSION AND SCALE DEPOSIT AND FOR RESTORING TUBES OF HEAT-EXCHANGING EQUIPMENT AND DEVICE FOR CARRYING OUT SAID METHOD

FIELD OF THE INVENTION

The invention relates to the art of protecting tubular heat-exchange equipment against corrosion and scale deposition, and particularly concerns a method for protecting the inner surface of the tubular heat-exchange equipment against corrosion and formation of scale deposits and a device to carry out this method.

Prior Art

Prior art contains a method for protecting the inner surfaces of the tubes against corrosion by applying varnish and paint coatings to the inner surface of the heat-exchange equipment tubes by dipping or pouring liquid varnish and paint materials with a viscosity of from 150 to 200 poise. The device to carry out this method comprising a loading chamber, elastic plugs, a rope, a receiving chamber, a winch barrel and a mechanical drive [V. N. Protasov. Polymeric coatings in the oil industry. Moscow, "Nedra", 1985, pp. 156-158].

The elastic coating plugs applied in this method ensure coating of the inner surface of the tube by a gradual transference of a definite amount of the varnish and paint material over the inner surface of the tube with forced removal of the varnish and paint material surplus from the surface being coated. The coating plug moves in the tube at a rate of 30-40 m/min.

A method and a device for protecting of the heat-exchange equipment tubes against corrosion by coating the inner surface of the tube by a gradual displacement motion of a surplus amount of the polymeric varnish and paint material over the inner surface of the tube with forced removal of the varnish and paint material surplus from the surface being coated and subsequent hardening of the coating are also known in the art [U.S. Pat. No. 3,885,521 A, Int. Cl. B05C7/06, published May 27, 1975].

The elastic coating pistons made from integrated rubber rings installed with possibility of translation over the tube with a rope provide coating of the inner surface of the tube by a gradual displacement of a definite amount of the varnish and paint material over the inner surface of the tube with the forced removal of the varnish and paint material surplus from the surface being coated.

The known methods for protecting the heat-exchange equipment tubes against corrosion and devices for the embodiment of the methods for protecting against corrosion and devices for the embodiment of the methods for protecting the inner surfaces of the heat-exchange equipment are generally suitable for treating a rather uniform surface, but they are unable to eliminate such defects of the heat-exchange equipment tube's surface as corrosion pits, cavities and through tube wall defects. Moreover such methods don't prevent formation of scale deposits on the tube walls.

SUMMARY OF THE INVENTION

The task is resolved by that in the method for protecting against corrosion and scale deposition and for restoring of the heat-exchange equipment tubes by applying of a polymeric coating to the inner surface of the tubes by the way of a translational displacement of a surplus amount of a polymeric material over the inner surface of the tube at a rate of 0.1-0.49 m/s with additional rotational displacement of the polymeric material over the inner surface of the tube at a linear rate of 0.4-1.0 m/s and subsequent hardening of the material, said material is a polymeric compound whose viscosity at the state of rest is 1000-12000 poise with a thixotropic decrease of its viscosity at above rate of its displacement.

The task is resolved also by that the polymeric compound is a filled polymeric compound based on epoxy or silicone, or phenol-formaldehyde, or furan, or polyamide, or acryl resins or mixes thereof.

The fillers of the polymeric compound may be metal powders or oxides thereof or metal alloys. The polymeric coating is hardened for at least 1,5 days at a temperature of 20-25° C. or for 1-2 hours at a temperature of 50-100° C.

To carry out this method a device is used for protecting against corrosion and scale deposition and for restoring of the heat-exchange equipment tubes comprising a loading chamber, a connecting washer, a means intended for translational-and-rotational displacement of a polymeric material and comprising at least two stiff washers spaced from each other, a rope, a mechanical drive and additionally containing an elastic auger with a possibility of translational-and-rotational displacement, wherein the rotational displacement is performed at a linear rate of 0.4-1.0 m/s, while the rate of the translational motion is 0.1-0.49 m/s.

The auger is of a conic shape with the conicity of 5-10° from the side opposite to the connecting washer.

The device of the present invention can perform a multiple-pass filling of pits and through tube wall defects and is able to apply a thin uniform layer of the polymeric material to the inner surface of the tube due to the fact that the device is provided with the means for translational movement comprising the stiff washers and the elastic conic auger with the conicity of 5-10° from the side opposite to the connecting washer. Said conicity of 5-10° of the auger starting from its middle part is necessary for smoothing the applied coating surface to avoid screw type furrows that are possible when the auger's form is cylindrical.

The stiff washers can be made from metal or such polymeric materials as fluoroplast. This is explained by the fact that the washers must be made from materials with a low coefficient of friction against the inner surface of the heat-exchange tube. The auger may be made from an elastic rubber.

BRIEF DESCRIPTION OF THE DRAWINGS

The subsequent specification contains a detailed description of the method for protecting against corrosion and formation of scale deposits and for restoring (reconditioning) of the heat-exchange equipment tubes by coating the inner surface of the tube and the device therefor with the reference to the accompanying drawing wherein.

THE BEST EMBODIMENT OF THE INVENTION

Figure 1:
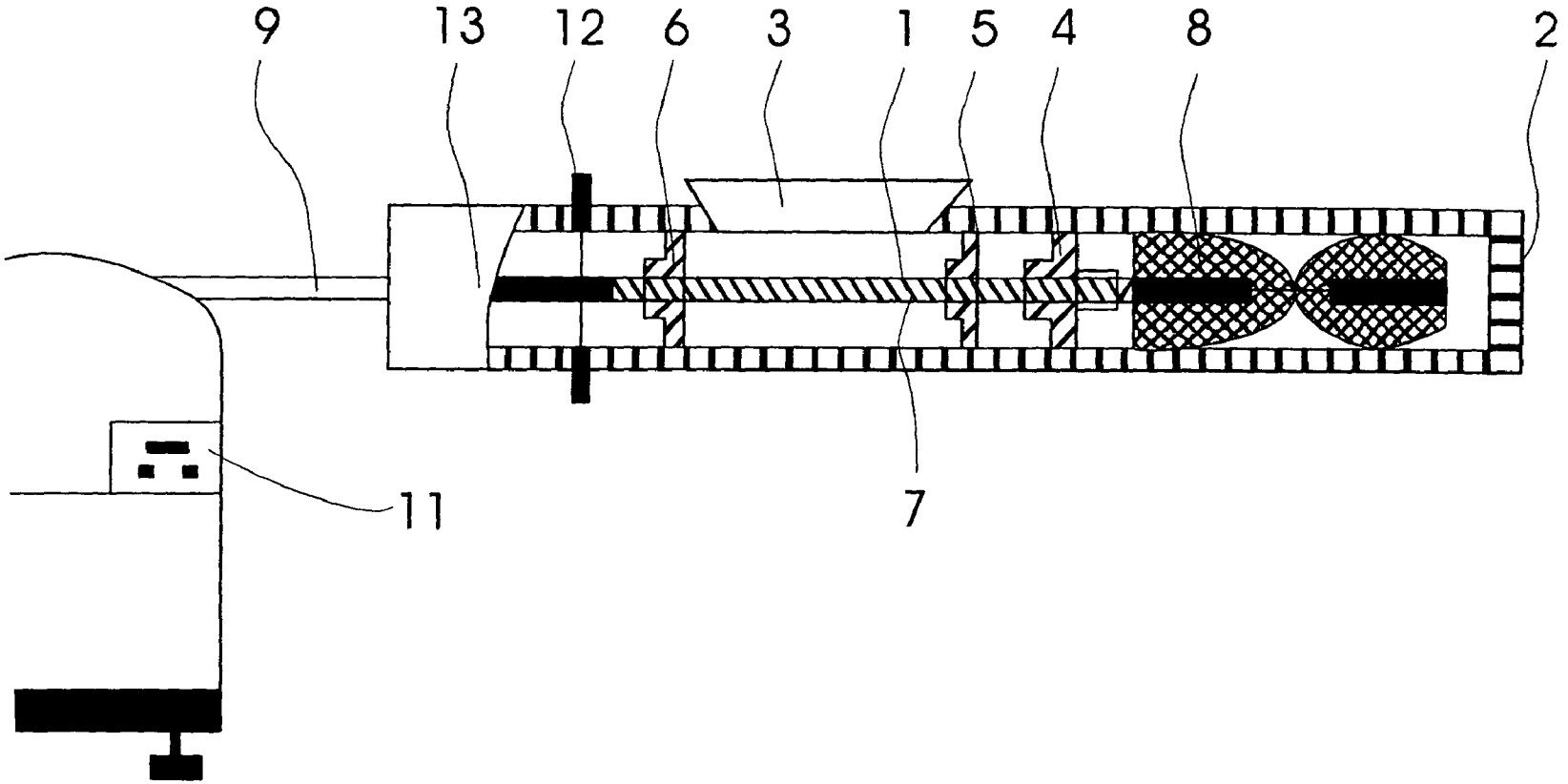
FIG. 1 shows schematically a general view of the device for applying the polymeric coating to the inner surface of the heat-exchange equipment tubes.

The proposed method is implemented as follows. The rope 9 connected to the barrel 10 is passed through the heat-exchange tube 13 (FIG. 1) to its end. Device 1 used for applying the polymeric coating is fixed to the opposite end of the rope 9, said device comprising the loading chamber 2, and the loading chamber is connected to the heat-exchange tube 13 with the connecting washer 12.

The loading chamber 2 is filled through funnel 3 with a polymeric compound taken with no less than a 30% excess of its estimated amount. The amount of the polymeric material to be used is determined, taking into account the inner surface area of the tubes being treated, the degree of their pitting and the required thickness of the coating. After this, the drive 11 mounted on barrel 10 is switched on, ensuring thereby the movement of the device for application of the compound along the heat-exchange tube. The stiff washers 4, 5 and 6 displace the polymeric compound by performing the translational-and-rotational motion and preliminary distribute the compound along the inner surface of the tube and in doing so a part of the compound penetrates to the auger 8 through a slot between the heat-exchange tube 13 and the washer 4, which slot is formed due to the difference between the inner diameter of the tube and the outer diameter of the washer.

The auger 8 by performing the translational-and rotational motion due to its elasticity and the shape carries out a multiple-pass filling of pits and through tube wall defects and ensures the uniformity of the thin layer of the polymeric material applied to the inner surface of the tube. The stiff washers ensure the elastic auger coaxiality. The stiff washers are intended for fixing the polymeric material in the space between them, for translating the material along the entire length of the heat-exchange tube and for distribution of the polymeric material through one of the washers in the amount necessary for the tube wall surfacing.

A qualitative filling of pits, cavities, slots or openings (through tube wall defects) in the tube walls, including microscopic surface defects, with the polymeric material is ensured due to a thixotropic decrease (2-20-fold) in the polymeric material's viscosity at the applied rates of the translational-and-rotational displacement of the material along the inner surface of the tube. When the auger has passed the tube the polymeric material's viscosity returns to the initial (maximum) value and the material doesn't pour out of pits, cavities, slots or openings but polymerizes in them thereby reconditioning the walls and returning them into the serviceable condition.

Thus, the advantage of the method and the device of the present invention is in the fact that they not only make it possible to protect the heat-exchange equipment tubes with a smooth inner surface against corrosion, but also to restore already corroded surfaces of the tubes, including filling up of through tube wall defects in the tube walls.

Besides, coating by the method of the present invention using the proposed device provides protection against scale deposition on the inner surface of the tubes by forming the smooth coating and ensures under the absence of surface irregularities not only on the repaired surface of the tubes, but also on the surface areas with deep corrosion pits or in the zone of through holes in the walls of the heat-exchange tubes.

As a result, formation of stagnation zones that are centers of scale deposition origin on the inner surface of the heat-exchange tubes protected by the polymeric compound is hampered and carrying away of pollutants from the coated surface of the tubes, which ingress to it with the water at typical cooling water flow rates (over 1 m/s) becomes easier.

The device for accomplishing the proposed method for protecting against corrosion and formation of scale deposits and for reconditioning of the heat-exchange equipment tubes by applying a polymeric coating to the inner surface of the heat-exchange equipment tubes comprises the device 1 for applying the polymeric coating along the heat-exchanger tube, said device 1 equipped with the loading chamber 2 with the funnel 3, the stiff washers 4, 5, 6 secured on a metal rod 7, and the elastic auger 8, the flexible rope 9, the barrel 10 and the drive 11. The connecting washer 12 is used to joint the device 1 for applying the polymeric coating to the heat-exchanger tube 13.

The device of the present invention operates as follows.

The flexible rope 9 is pulled through the heat-exchange tube 13 up to its end wherein the end of the flexible rope 9 is fixed to the device 1 equipped with the loading chamber 2 and is connected to the heat-exchange tube 13 to be protected with the connecting washer 12. After charging the polymeric compound to the loading chamber 2, the drive 11 on the barrel 10 is started up to ensure the translational-and-rotational motion for applying the compound along the inner surface of the heat-exchange tube.

Excessive amount of the material penetrate through the washer 4 to the elastic auger 8 during the translational motion, said auger distributes the polymeric material uniformly along the inner surface of the tube 13, ensuring thereby a multiple-pass filling of corrosion pits and through tube wall defects.

Given bellow is a specific example of using of the method of the present invention.

The polymeric coating was applied to the condensation unit heat-exchange tubes of 7 m in length, with an outer diameter of 23 mm and an inner diameter of 21.5 mm with corrosive damage in the form of corrosion pits of 5-6 mm in diameter and up to 0.5 mm in depth as well as in the form of through wall defects up to 1.5 mm in diameter. To apply the polymeric coating the rope connected to the barrel was passed through the tube up to its end. The device 1 used for the application of the polymeric coating equipped with the loading chamber 2 was connected to the opposite end of the rope 9, said chamber was connected to the heat-exchanger tube 13 using the connecting washer 12. The loading chamber 2 was filled through the funnel 3 with 100 g of epoxy compound filled with titanium dioxide $TiO_2$ with an initial material viscosity of 9000 poise. After this the drive 11 on the barrel 10 was switched on ensuring thereby the motion of the device for the application of the compound along the heat-exchange tube 13. The washers 4, 5 and 6 ensure feeding of the polymeric compound to the elastic auger by performing a translational motion at a rate of 0.15 m/s, which, in its turn, displaces the compound over the inner surface of the tube at a linear rate of 0.8 m/s. By reducing the compound's viscosity down to 500-600 poise it is possible to ensure the complete filling of all corrosion pits and through wall defects and to apply a uniform 50 μm thick polymeric layer to the inner surface of the heat-exchange tube. After application of the polymeric compound to the tube surface, its viscosity recovers up to 9000 poise. The hardening time of the polymeric coating is 36 hours at a temperature of 20° C. After six months the coated heat-exchange tubes were checked for proper coating. The examination has shown that the polymeric coating remained intact all over the tube length, no defects were revealed and the coating preserved its original color, smoothness and gloss. No scale deposits were detected. Thermophysical parameters suited the norm.

Industrial applicability

The proposed method for protecting the heat-exchange equipment tubes against corrosion and formation of scale deposits and the device therefor can be used to protect the inner surface of the heat-exchange equipment tubes against corrosion and formation of scale deposits and to recondition already corroded tubes of the heat-exchange equipment used in the chemical and petrochemical industry.

The invention claimed is:

1. A device for protecting against corrosion and scale depositions and for restoring of a heat-exchanging tube comprising: a loading chamber, a connecting washer connecting the loading chamber to the tube, and a unit providing for translational-and-rotational displacement of a polymeric compound, the unit comprising at least two stiff washers spaced from each other, a rope, a mechanical drive and additionally containing an elastic auger causing the translational-and-rotational displacement of the polymeric compound, wherein the rotational displacement is performed at a linear rate of 0.4-1.0 m/s, while the rate of the translational motion is 0.1-0.49 m/s, wherein said polymeric compound has a viscosity at a state of rest of 1000-1200 poise, and the unit provides an application of said polymeric compound at a 2 to 20 fold thixotropic decrease of its viscosity.

2. The device according to claim 1, wherein said auger is of a conic shape with the conicity of 5-10° from the side opposite to the connecting washer.

3. A method for protecting against corrosion and scale deposition and for restoring of a heat-exchanging tube having an inner surface with pits, cavities, slots, openings, microscopic surface defects, or through tube defects, said method comprising:

applying a polymeric coating to the inner surface of the tube by the way of a translational displacement of a surplus amount of a polymeric compound over the inner surface of the tube at a rate of 0.1-0.49 m/s with additional rotational displacement of the polymeric compound over the inner surface of the tube at a linear rate of 0.4-1.0 m/s, and subsequent hardening of the polymeric compound, wherein said polymeric compound has a viscosity at a state of rest of 1000-12000 poise, and said application of said polymeric compound occurs at a 2 to 20 fold thixotropic decrease of its viscosity so as to completely fill the pits, cavities, slots, openings, microscopic surface defects, or through tube defects in said inner surface of the tube by polymerizing therein.

4. The method according to claim 3, wherein the polymeric compound is a filled polymeric compound based on epoxy, silicone, phenol-foiuialdehyde, furan, polyamide, acryl resins, or combinations thereof.

5. The method according to claim 4, wherein the fillers of the polymeric compound are metal powers or oxides thereof.

6. The method according to claim 4, wherein the fillers of the polymeric compound are metal alloys.

7. The method according to claim 5, wherein the polymeric coating is hardened for at least 1.5 days at a temperature of 20-25° C.

8. The method according to claim 5, wherein the polymeric coating is hardened for 1-2 hours at a temperature of 50-100° C.

9. The method according to claim 6, wherein the polymeric coating is hardened for at least 1.5 days at a temperature of 20-25° C.

10. The method according to claim 6, wherein the polymeric coating is hardened for 1-2 hours at a temperature of 50-100° C.

* * * * *

UNITED STATES PATENT AND TRADEMARK OFFICE

CERTIFICATE OF CORRECTION

PATENT NO. : 7,836,844 B2
APPLICATION NO. : 10/485580
DATED : November 23, 2010
INVENTOR(S) : Vladinir Anatolievich Golovin et al.

It is certified that error appears in the above-identified patent and that said Letters Patent is hereby corrected as shown below:

(1) in Claim 1, column 5, line 15 of the Patent, change "1000-1200 poise" to --1000-12000 poise--.

(2) in Claim 4, column 6, line 11 of the Patent, change "phenol-foiuialdehyde" to --phenol-formaldehyde--.

Signed and Sealed this
Fifteenth Day of February, 2011

David J. Kappos

David J. Kappos
*Director of the United States Patent and Trademark Office*